US006308905B1

(12) United States Patent
Balvanz et al.

(10) Patent No.: US 6,308,905 B1
(45) Date of Patent: Oct. 30, 2001

(54) SIZE REDUCING MACHINE WITH SERRATED TOP WEAR PLATE

(75) Inventors: Loran Balvanz; Paul Gray, both of New Providence, IA (US)

(73) Assignee: U.S. Manufacturing, Inc., New Providence, IA (US)

( * ) Notice: Subject to any disclaimer, the term of this patent is extended or adjusted under 35 U.S.C. 154(b) by 0 days.

(21) Appl. No.: 09/542,094

(22) Filed: Apr. 3, 2000

(51) Int. Cl.[7] ..... B02C 13/28

(52) U.S. Cl. ..... 241/73; 241/101.761; 241/186.4; 241/197

(58) Field of Search ..... 241/73, 101.761, 241/186.4, 189.1, 300, 197, 243

(56) References Cited

U.S. PATENT DOCUMENTS

| | | | | |
|---|---|---|---|---|
| 797,616 | | 8/1905 | Schutz . | |
| 1,761,083 | | 6/1930 | Liggett . | |
| 2,467,865 | | 4/1949 | Smith . | |
| 3,580,517 | * | 5/1971 | Ehrlich | 241/186.4 |
| 4,033,515 | * | 7/1977 | Barcell et al. | 241/101.761 |
| 4,066,216 | * | 1/1978 | Waldrop et al. | 241/101.761 |
| 4,136,833 | | 1/1979 | Knight . | |
| 4,315,605 | | 2/1982 | Vargo . | |
| 4,702,426 | | 10/1987 | Citterio . | |
| 4,907,750 | | 3/1990 | Seifert . | |
| 5,022,593 | | 6/1991 | Stelk . | |
| 5,285,974 | | 2/1994 | Cesarini . | |
| 5,775,608 | | 7/1998 | Dumaine et al. . | |
| 5,785,263 | | 7/1998 | Wu et al. . | |

* cited by examiner

*Primary Examiner*—Mark Rosenbaum
(74) *Attorney, Agent, or Firm*—Daniel A. Rosenberg; Kent A. Herink; Davis Brown Law Firm

(57) ABSTRACT

The present invention comprises a size reducing machine with a rotor having a plurality of hammers arranged to size reduce waste material upon impact. The rotor is contained with a tub that includes a tub floor for feeding the waste material toward the rotor. Located proximate to the tub floor is a gator plate with a serrated edge for initial material for sizing of the waste material.

5 Claims, 3 Drawing Sheets

SIZE REDUCING MACHINE WITH SERRATED TOP WEAR PLATE

BACKGROUND OF THE INVENTION

The present invention relates to an improved top wear plate for a size reducing machine. In particular, to a serrated top wear plate that includes a plurality of pointed edges against which waste material is size reduced after being impacted by a hammer of a size reducing machine.

Size reducing machines, like tub grinders, rotary hammermills, and the like, typically consist of a rotor rotated about a central shaft by a motor. The rotor contains a plurality of hammers that further include inserts that impact waste material introduced into the machine. The waste material travels along the floor of the machine and onto a top wear plate. As the waste material enters the path of the rotor, the hammers strike the waste material against the top plate. The edge of the top plate comprises a primary wear surface, and serves the function of initially size reducing the waste material. In other words, the amount of separation between the top plate and the hammer tips in large part determines the size of the initial break in the waste material.

After initial impact the partially size reduced material is typically directed toward a side wear plate and then into the partially enclosed rotor area, whereupon the hammers continue to impact the material until the material reaches a size sufficient to allow the waste material to pass through a screen thereby exiting the size reducing machine.

In the prior art, the top plate consists of a long rectangular piece of plate steel material, or series of plates, that span the length of the rotor area of the size reducing machine. The leading edge of the top plate is reinforced with a hard-face weld, to provide better wear resistance.

The prior art design suffers from not only wear problems, but the flat planer edge of the top plate requires the waste material to fracture along the entire length of the leading edge of the top plate. This creates resistance to the break up of the material and increases the amount of force required to initially size reduce the waste material. Thus, a need exists for a size reducing machine that uses a top plate the allows for more efficient initial size reduction of waste material.

SUMMARY OF THE INVENTION

An object of the present invention comprises providing a size reducing machine with a serrated gator plate for use in size reducing waste material.

These and other objects of the present invention will become apparent to those skilled in the art upon reference to the following specification, drawings, and claims.

The present invention intends to overcome the difficulties encountered heretofore. To that end, the present invention comprises a size reducing machine with a rotor having a plurality of hammers arranged to size reduce waste material upon impact. The rotor is contained with a tub that includes a tub floor for feeding the waste material toward the rotor. Located proximate to the tub floor is a gator plate with a serrated edge for initial sizing of the waste material.

DETAILED DESCRIPTION OF THE INVENTION

Figure 1:
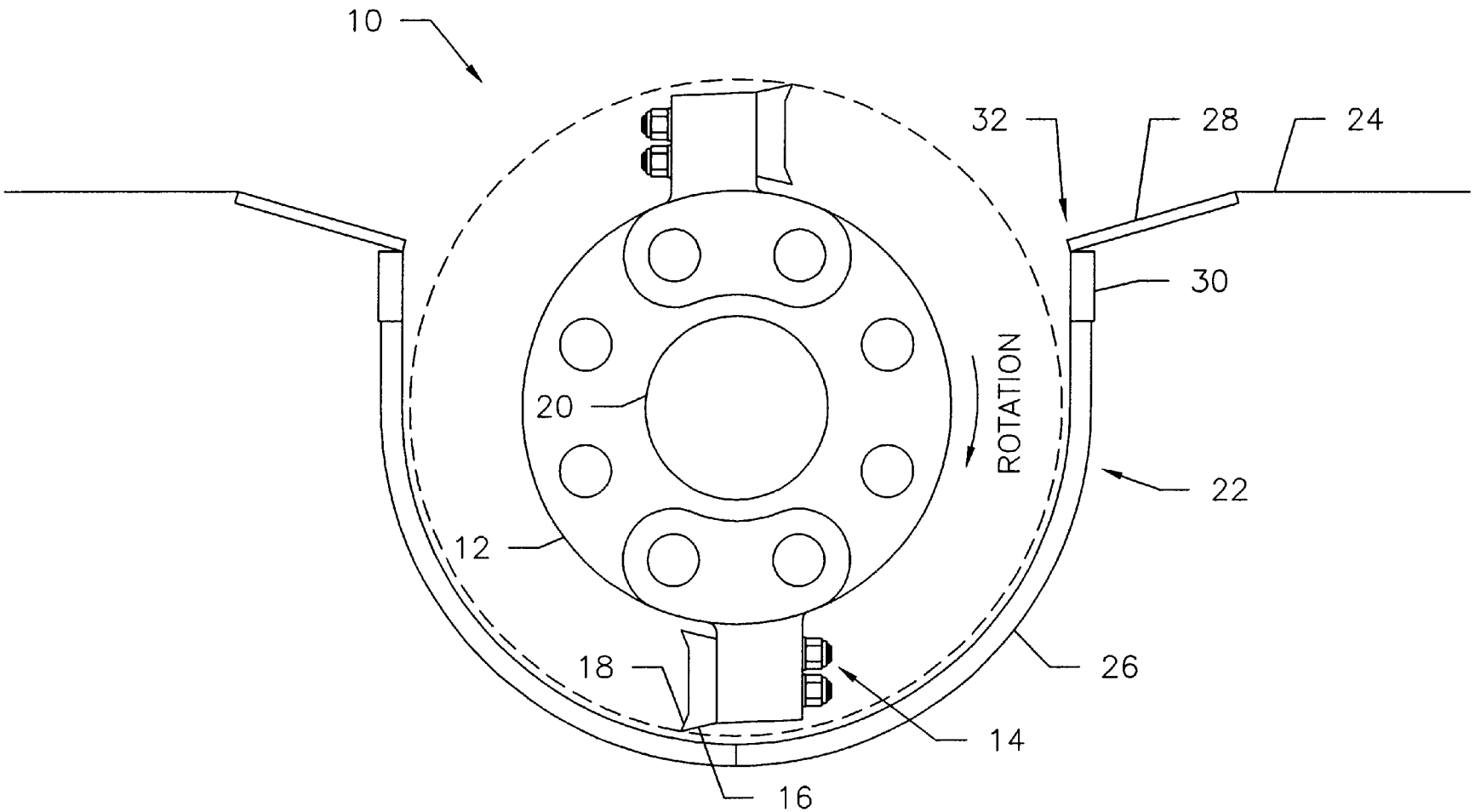
FIG. 1 (Prior Art)
FIG. 1 shows the side view of a size reducing machine with a prior art top plate.

In the Figures, FIG. 1 shows a size reducing machine 10 with a rotor 12. The rotor includes a plurality of hammers 14, which include bolt-on inserts 16 with tips 18 that impact waste material (not shown) for the purpose of size reduction. The rotor 12 rotates on a central shaft 20 thereby creating sufficient force to size reduce waste material upon impact. The size reducing machine 10 also includes a tub 22 comprised of a tub floor 24, and a screen 26. The tub floor 24 allows for introduction of the waste material into the size reducing machine 10. The screen 26 is sized to allow waste material to pass through thereby exiting the size reducing machine 10.

Between the tub floor 24 and the rotor 12 is a prior art top wear plate 28. Below the top plate 28 and above the screen 26 is a side wear plate 30. The top plate 28 forms a ledge from which to feed the waste material into the path of the hammers 14 of the rotor 12. The tips 18 strike the waste material which forces the waste material against a leading edge 32 of the top plate 28. This results in the initial sizing of the waste material. Next, the waste material impacts the side wear plate 30. The waste material continues to circulate within the tub 22 further impacting with the hammers 14 until sufficiently size reduced to pass through the screen 26 of the tub 22.

Figure 2:
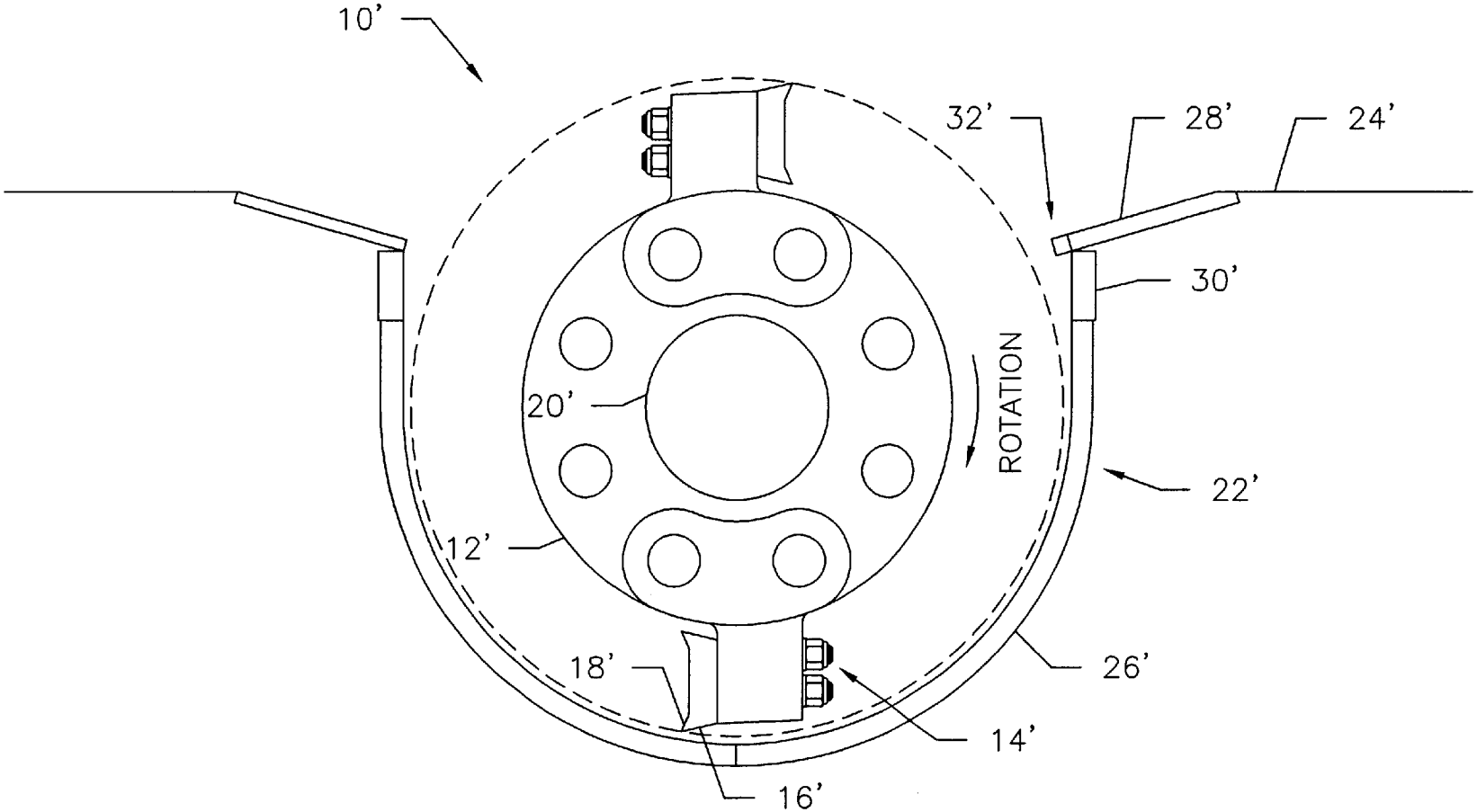
FIG. 2 shows the side view of a size reducing machine with a gator plate.
Figure 3:
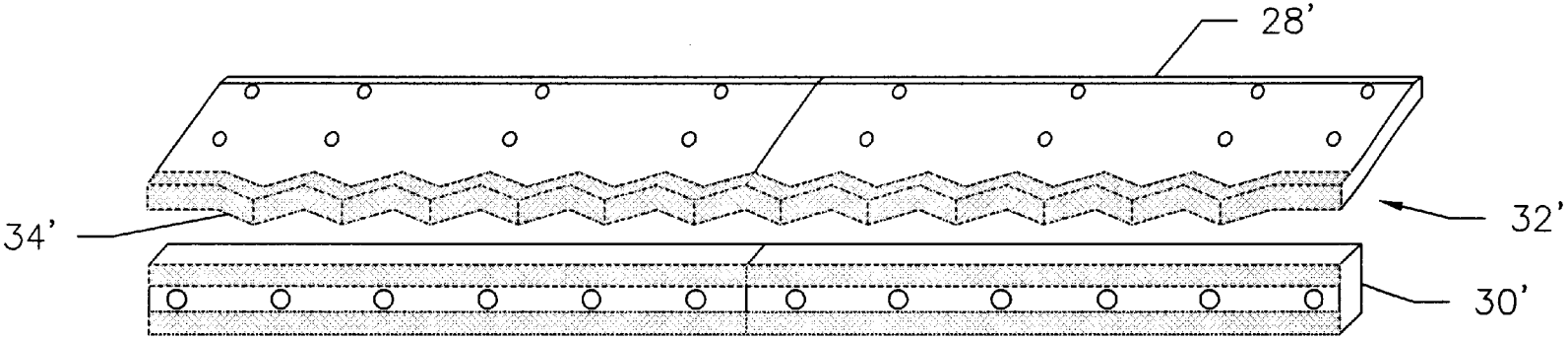
FIG. 3 shows an end view of the gator plate and side plate of the size reducing machine of FIG. 2.
Figure 4:
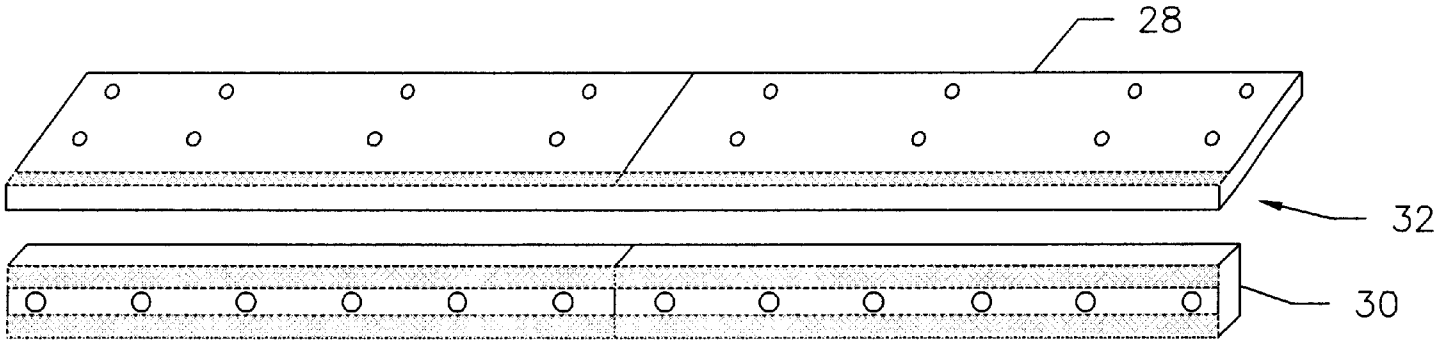
FIG. 4 (Prior Art)
FIG. 4 shows an end view of the top plate and side plate of the size reducing machine of FIG. 1.

FIG. 2 shows a size reducing machine 10', essentially identical to the size reducing machine 10, except for the presence of the serrated gator plate 28'. The serrated gator plate 28' includes a serrated leading edge 32'. FIG. 3 shows that the leading edge 32' of the serrated gator plate 28' includes a plurality of forward extending points 34' across the entire face of the leading edge 32' of the serrated gator plate 28'. The forward extending points 34' of the serrated leading edge 32' protrude further into the debris path, and are closer to the rotor 12' than in the prior art design. The serrated gator plate 28' is also thicker than the prior top gator plate 28 (see FIG. 4). The leading edge 32' of the serrated gator plate 28' is covered with a hard-face weld to provide for additional wear resistance.

The design of the serrated gator plate 28' allows for more efficient operation of the size reducing machine 10'. The forward extending points 34' provide a plurality of sharp edge points 34' to focus the impacting force, thereby facilitating the break-up of the waste material. In relation to the leading edge 32 of the top plate 28, the serrated leading edge 32' reduces the amount of force needed to size reduce the waste material, and improves fuel consumption contributing to overall increased efficiency of operation of the size reducing machine 10'. The increased width of the serrated gator plate 28' provides additional strength and provides for a larger leading edge 32' for material to strike. The hard-faced weld along the entire serrated leading edge 32', increases the useful life of the gator plate 28' over that of the prior art design. In this manner, the size reducing machine 10', and in particular the serrated gator plate 32', substantially eliminates the problems associated with the prior art design.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

What is claimed is:

1. A size reducing machine with a serrated gator plate for use in size reducing waste material, said size reducing machine comprising:

a rotor with a plurality of hammers rotating about a central shaft;

an insert with a tip attached to said hammers for size reducing waste material upon impact with said tips, wherein rotating said central shaft defines an outer perimeter of rotation at said tips;

a tub for containing said rotor and said central shaft, wherein said tub includes a tub floor for feeding material into toward said rotor; and a gator plate located between said tub floor and said rotor having a serrated edge for initial material sizing, wherein said serrated edge of said gator plate is located at or near said outer perimeter of rotation.

2. The invention in accordance with claim 1 wherein said tub further comprises a screen sized to allow sized reduced material to pass through thereby exiting said size reducing machine.

3. The invention in accordance with claim 1 further comprising a side wear plate located below said gator plate and above said screen.

4. The invention in accordance with claim 3 wherein said serrated edge of said gator plate extends inward beyond said side wear plate.

5. The invention in accordance with claim 1 wherein said serrated edge of said gator plate is covered with a hard-faced weld.

* * * * *